US005675940A

United States Patent [19]

Bahar et al.

[11] Patent Number: 5,675,940

[45] Date of Patent: Oct. 14, 1997

[54] SKYLIGHT LEAKAGE BARRIER

[76] Inventors: Reuben Bahar, 23708 Welby Way, West Hills, Calif. 91307; Moshe J. Ozeri, 23036 Burbank Blvd., Woodland Hills, Calif. 91367

[21] Appl. No.: 731,458

[22] Filed: Oct. 15, 1996

[51] Int. Cl.[6] ..... E04D 13/14; E06B 1/04

[52] U.S. Cl. ..... 52/58; 52/200; 52/24; 52/97; 52/302.1

[58] Field of Search ..... 52/58, 60, 219, 52/200, 97, 24, 302.1, 302.6

[56] References Cited

FOREIGN PATENT DOCUMENTS 94000655 1/1994 WIPO ..... 52/58

*Primary Examiner*—Robert Canfield

*Attorney, Agent, or Firm*—Edgar W. Averill, Jr.

[57] ABSTRACT

A skylight leakage barrier for reducing the tendency of a skylight assembly to leak during heavy rainstorms. The skylight leakage barrier has a generally vertical top barrier which extends across the top edge of the skylight assembly. The top barrier has two downwardly depending side barriers and the top barrier and side barriers are separated from the skylight assembly by a distance of several inches. The result of the use of the leakage barrier is a substantial reduction in the tendency of the skylight assembly to leak during heavy rainstorms.

3 Claims, 1 Drawing Sheet

SKYLIGHT LEAKAGE BARRIER

BACKGROUND OF THE INVENTION

The field of the invention is roofing and the invention relates more particularly to the sealing of skylights and other members which extend through a roof surface. Skylights are very useful and attractive features of residences and commercial buildings, but such skylights are known to have a tendency to leak during heavy rainstorms. Often many attempts are made to patch and seal the skylight assembly to eliminate such leakage and often such efforts are not successful.

One system for attempting to solve this problem is shown in U.S. Pat. No. 3,455,073 where an angled sheet is shown around the curb or frame which supports the skylight. Various wind deflectors are used in the skylights of motor vehicles and one such ventilator is shown in U.S. Pat. No. 2,173,890. Such approaches are not useful for solving the typical skylight leakage problem. The classic prior art approach being merely to apply more and more roofing cement over the periphery of the skylight frame.

BRIEF SUMMARY OF THE INVENTION

It is an object of the present invention to provide a simple, economical and effective device for reducing the tendency of a skylight to leak during a heavy rainstorm.

The present invention is for a skylight leakage barrier for reducing the propensity of a skylight assembly to leak during a heavy rainstorm. The skylight assembly includes a rectangular curb mounted around the opening in a roof surface. The curb includes an upper edge, a first side edge, a second side edge and a bottom edge. The skylight leakage barrier comprises a generally vertical first side barrier fabricated from a weatherproof material. The first side barrier is held to the roof surface in a watertight manner and separated from the first side edge of the curb at least about 5 inches and no more than 18 inches. A generally vertical top barrier is fabricated from a weatherproof material and is held to the roof surface in a watertight manner and extends from the top side of the first side barrier above and separated from the upper edge of the curb at least 5 inches and no more than about 18 inches. A generally vertical second side barrier is also fabricated from a weatherproof material and extends downwardly from the vertical top barrier separated from the second side edge of the curb at least about 5 inches and no more than about 18 inches. These barriers should be at least about 8 inches high. Preferably they are fabricated from sheet metal.

DESCRIPTION OF THE PREFERRED EMBODIMENTS

Figure 1:
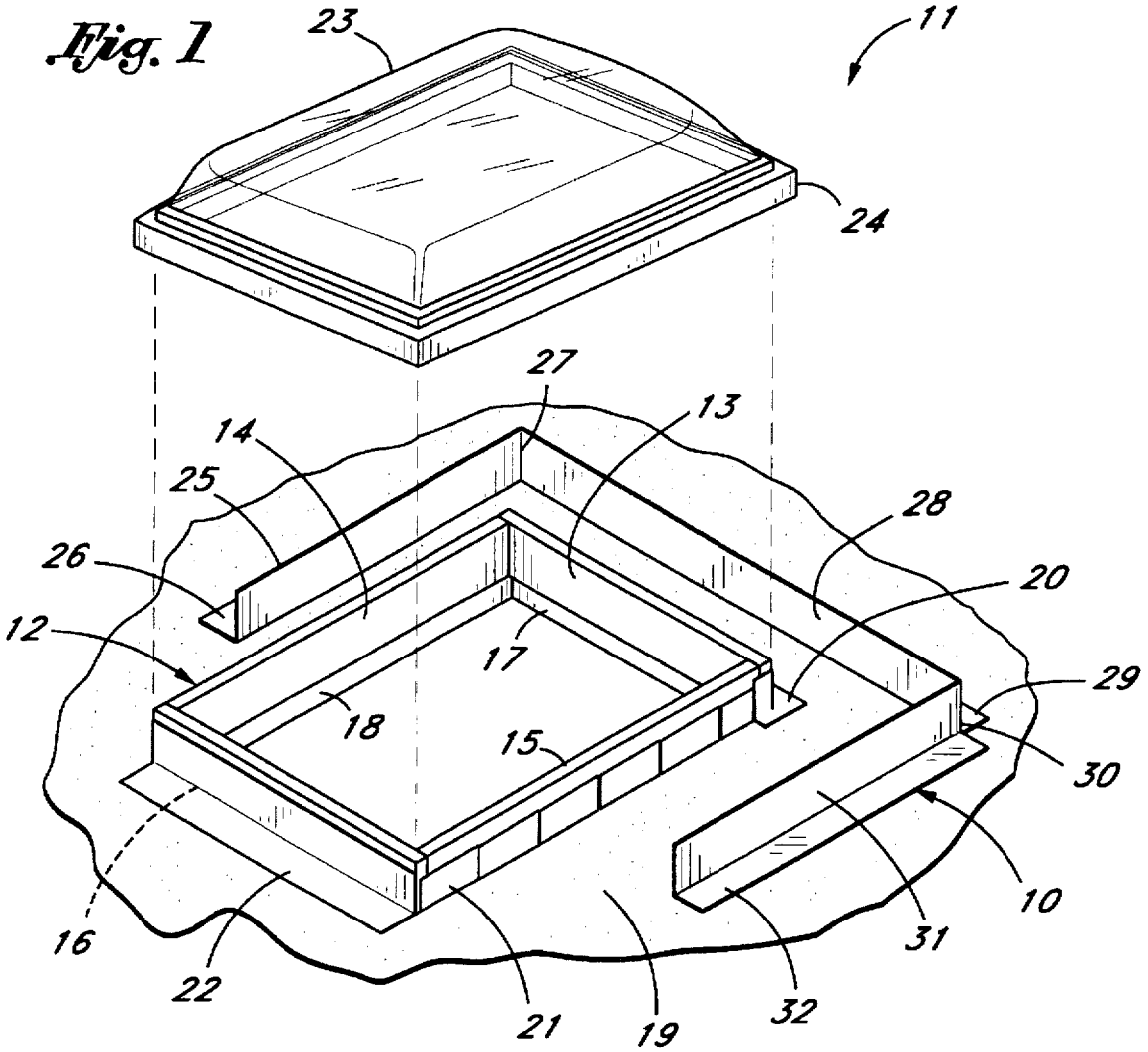
FIG. 1 is a perspective view of a skylight assembly surrounded by the skylight leakage barrier of the present invention.

A skylight leakage barrier is shown in perspective view and indicated generally by reference character 10. Skylight leakage barrier 10 surrounds the top and two sides of a skylight assembly. The skylight assembly is indicated generally by reference character 11. The skylight assembly 11 has a curb 12 which has an upper edge 13, a first side edge 14, a second side edge 15 and a bottom edge 16. The curb is secured to a header 17 and two rafters 18.

A common method of sealing curb 12 to a roof surface 19 is with a saddle flashing 20 sealed to roof surface 19 and also sealed to the upper edge 13. Lengths of step flashing 21 are sealed along one side to roof surface 19 along the other side to the outer edge of the first side edge 14 and the second side edge 15. A bottom apron 22 is placed between bottom edge 16 and roof surface 19. The assembly is then covered with roofing cement and typically the skylight 23 and skylight frame 24 are placed over the thus sealed curb and in turn sealed thereto by roofing cement. Without skylight leakage barrier 10, however, this prior art method is very often deficient, particularly in heavy rainstorms.

The skylight leakage barrier 10 has a generally vertical first side barrier 25 fabricated from a weatherproof material such as aluminum. Preferably first side barrier 25 in addition to its generally vertical portion has a generally horizontal portion 26 which may be sealed to the roof surface 19 in a conventional manner. First side barrier 25 is positioned a distance of at least 5 inches and no more than about 18 inches from first side edge 14 of curb 12. First side barrier 25 should be at least 8 inches in height. First side barrier 25 has a top side 27 which is integral with or otherwise sealed to a generally vertical top barrier 28. This, of course, is also fabricated from a weatherproof material and is held to the roof surface in a watertight manner preferably by horizontal portion 29. This top barrier 28 should be separated from upper edge 13 at least 5 inches and no more than about 18 inches. Top barrier 28 has a right side 30 which is integral with or otherwise sealed to a second side barrier 31 which is likewise fabricated from a weatherproof material and sealed to roof surface 19. Like first side barrier 25, second side barrier 31 should be separated from curb 12 a distance of at least 5 inches and no more than about 18 inches. A generally horizontal portion 32 permits the second side barrier 31 to be sealed to roof surface 19. Surprisingly, it has been found that the mere installation of skylight leakage barrier 10 eliminates almost all leakage problems even during the heaviest rainstorms. It is believed that by diverting the major flow of water, the water does not tend to flow upwardly and around the roofing cement designed to prevent leakage. The very small amount of water which falls between skylight leakage barrier 10 and curb 12 is readily handled by the conventional sealing method.

Figure 2:
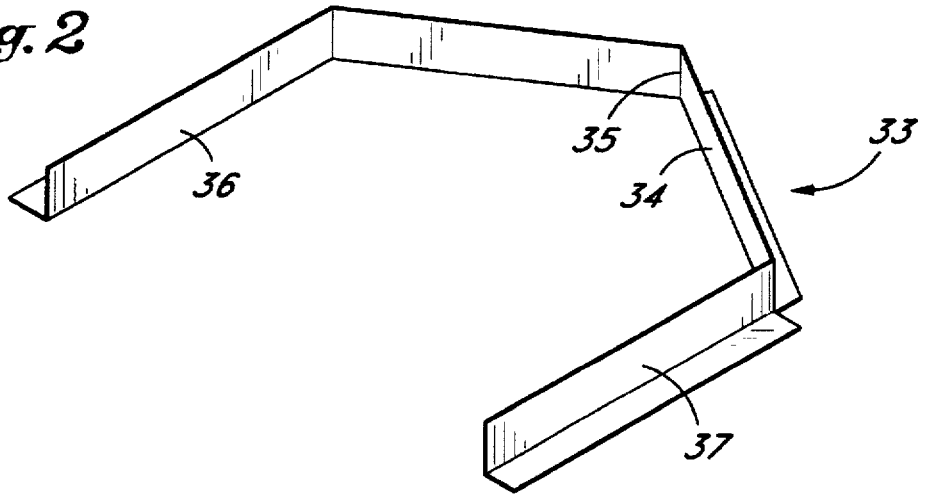
FIG. 2 is a perspective view of an alternate configuration of the skylight leakage barrier of FIG. 1.

An alternate configuration of skylight barrier 10 is shown in perspective view in FIG. 2 and indicated generally by reference character 33. In leakage barrier 33 the top barrier 34 has an angled bend at the center thereof which tends to assist in diverting water along first side 36 and second side 37. Like barrier 10, it is separated from the curb 12 the same distance range, except that the angled bend portion can be slightly further separated.

The positioning of skylight leakage barrier 10 should take into consideration the direction of water flow along roof surface 19. If the skylight happened to be angled such that flowing water only struck the first side edge and upper edge, then only two lengths of barrier would be required, although three is generally preferred. It is also contemplated that barriers could completely surround the curb where the flow of water is variable such as on a generally flat roof.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A skylight leakage barrier and skylight curb assembly for reducing the propensity of a skylight assembly to leak during a heavy rainstorm, comprising:

a rectangular curb mounted around a rectangular opening in a roof surface, said curb including an upper edge, a first side edge and a second side edge and a bottom edge;

a generally vertical first side barrier fabricated from a weatherproof material, said generally vertical first side barrier being held to the roof surface in a watertight manner separated from said first side edge of said curb at least about 5 inches and no more than about 18 inches, said generally vertical first side barrier having a top side and a bottom side and a height of at least 8 inches;

a generally vertical top barrier fabricated from a weatherproof material, said generally vertical top barrier being held to said roof surface in a watertight manner and extending from the top side of said first side barrier, above and separated from said upper edge of said curb at least 5 inches and no more than about 18 inches, said generally vertical top barrier having a height of at least 8 inches;

a generally vertical second side barrier fabricated from a weatherproof material, said generally vertical second side barrier extending from said generally vertical top barrier and being held to the roof surface in a watertight manner separated from said second side edge of the curb at least about 5 inches and no more than about 18 inches, said generally vertical second side barrier having a top side and a bottom side and a height of at least 8 inches, whereby water from a heavy rain storm is diverted from said skylight assembly and the tendency of the skylight assembly is substantially reduced; and wherein the top barrier has an angled bend near a center thereof and the angled bend is pointing away from the skylight curb assembly so that any rain water is diverted away from said angled bend toward the first and second side barriers.

2. The skylight leakage barrier and skylight curb assembly of claim 1 wherein said first side, top and second side barriers each have an outwardly extending flap for affixing to the roof surface.

3. The skylight leakage barrier and skylight curb assembly of claim 1 wherein said first side, top and second side barriers are fabricated from sheet metal.

* * * * *